US006547002B1

(12) United States Patent
Bailey et al.

(10) Patent No.: US 6,547,002 B1
(45) Date of Patent: Apr. 15, 2003

(54) HIGH PRESSURE ROTATING DRILLING HEAD ASSEMBLY WITH HYDRAULICALLY REMOVABLE PACKER

(75) Inventors: Thomas F. Bailey, Houston, TX (US); Mike A. Luke, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/550,508

(22) Filed: Apr. 17, 2000

(51) Int. Cl.[7] ..... E21B 33/03
(52) U.S. Cl. ..... 166/84.4; 166/383; 175/84
(58) Field of Search ..... 175/195, 210, 175/84; 166/368, 383, 84.3, 84.4, 93.1

(56) References Cited

U.S. PATENT DOCUMENTS

| | | | | |
|---|---|---|---|---|
| 4,293,047 A | * | 10/1981 | Young | 175/195 |
| 4,423,776 A | | 1/1984 | Wagoner et al. | 166/84 |
| 4,448,255 A | | 5/1984 | Shaffer et al. | 166/387 |
| 4,480,703 A | * | 11/1984 | Garrett | 175/195 |
| 4,531,580 A | | 7/1985 | Jones | 166/84 |
| 4,825,938 A | | 5/1989 | Davis | |
| 5,022,472 A | | 6/1991 | Bailey et al. | 175/195 |
| 5,588,491 A | * | 12/1996 | Brugman et al. | 166/383 |
| 5,735,502 A | | 4/1998 | Levett et al. | |
| 5,848,643 A | | 12/1998 | Carbaugh, et al. | |
| 6,230,824 B1 | | 5/2001 | Peterman et al. | 175/214 |

FOREIGN PATENT DOCUMENTS

| | | | |
|---|---|---|---|
| DE | 37 39 533 | 11/1987 | E21C/1/00 |

OTHER PUBLICATIONS

PCT International Search Report from PCT/GB 01/01670, Dated Aug. 28, 2001.

Michael J. Tangedahl and Charles Rick Stone, "Rotating preventers: Technology for better well control," World Oil, No. 10, Houston, Texas, Oct. 1992, pp. 63–64, 66.

* cited by examiner

*Primary Examiner*—Frank S. Tsay
(74) *Attorney, Agent, or Firm*—Moser, Patterson & Sheridan, L.L.P.

(57) ABSTRACT

The present invention generally provides a reduced downtime maintenance apparatus and method for replacing and/or repairing a subassembly in sealing equipment for oil field use. The invention allows the removal of rotating portions of a rotary drilling head without having to remove non-rotating portions. The reduction in weight and size allows a more efficient repair and/or replacement of a principal wear component such as a packer. Specifically, the packer in a rotary drilling head can be removed independent of bearings and other portions of the rotary drilling head. Furthermore, because of the relatively small size and light weight, the packer can be removed typically without having to use a crane to lift a rotary BOP and without disassembling portions of the drilling platform. In some embodiments, the packer can be removed with the drill pipe without additional equipment. Furthermore, the packer can be removed remotely without necessitating manual disengagement typically needed below the platform. The invention also provides a fluid actuated system to maintain a pre-load system on the bearing.

28 Claims, 13 Drawing Sheets

HIGH PRESSURE ROTATING DRILLING HEAD ASSEMBLY WITH HYDRAULICALLY REMOVABLE PACKER

BACKGROUND OF THE INVENTION

1. Field of the Invention

The present invention relates to removable subassemblies in sealing equipment. Specifically, the invention relates to removable subassemblies in oil field rotary drilling head assemblies.

2. Background of the Related Art

Drilling an oil field well for hydrocarbons requires significant expenditures of manpower and equipment. Thus, constant advances are being sought to reduce any downtime of equipment and expedite any repairs that become necessary. Rotating equipment is particularly prone to maintenance as the drilling environment produces abrasive cuttings detrimental to the longevity of rotating seals, bearings, and packing glands.

FIG. 1 shows an exemplary drilling rig 10. The drilling rig 10 is placed over an area to be drilled and a drilling bit (not shown) is attached to sections of drill pipe 12. Typically, a rotary turntable 14 rotates a drive member 16, referred to as a kelly, which in turn is attached to the drill pipe 12 and rotates the drill pipe to drill the well. In some arrangements, a kelly is not used and the drill string is rotated by a drive unit (not shown) attached to the drill pipe itself. Typically, a mixture of drilling fluids, referred to as mud, is injected into the well to lubricate the drill bit (not shown) and to wash the drill shavings and particles from the drill bit and then return up through an annulus surrounding the drill pipe 12 and out the well through an outflow line 22 to a mud pit 24. New sections of drill pipe 12 are added to the drill pipe in the well using a crane 26 and a block and tackle 28 to collectively form a drill string 30 as the well is drilled deeper to the desired underground strata 32. A power unit 34 powers a control unit 36 and associated motors, pumps, and other equipment (not shown) mounted on a drilling platform 38.

In many instances, the strata 32 produce gas or fluid pressure which needs control throughout the drilling process to avoid creating a hazard to the drilling crew and equipment. To seal the mouth of the well, one or more blow out preventers (BOP) are mounted to the well and can form a blow out preventer stack 40. An annular BOP 42 is used to selectively seal the lower portions of the well from a tubular body 44 which allows the discharge of mud through the outflow line 22. A rotary drilling head 46 is mounted above the tabular body 44 and is also referred to as a rotary blow out preventer. An internal portion of the rotary drilling head 46 is designed to seal around a rotating drill pipe 30 and rotate with the drill pipe by use of a internal sealing element, referred to as a packer (not shown), and rotating bearings (also not shown) as the drill pipe is axially and slidably forced through the drilling head 46. However, the packer wears and occasionally needs replacement. Typically, the drill string or a portion thereof is pulled from the well and a crew goes below the drilling platform 38 and manually disassembles the rotary drilling head 46. Typically, a crane 26 is used to lift the rotary drilling head 46 which can weigh thousands of pounds. Because of the size of the drilling head 46, portions of the drilling platform 38 and equipment are disassembled to allow access to the drilling head and to remove the drilling head from the BOP stack 40. The drilling head 46 is replaced or reworked and crew goes below the drilling platform to reassemble the drilling head to the BOP stack 40 and operation is resumed. The process is time consuming and can be dangerous.

Prior efforts have sought to reduce the complexity of the drilling head replacement. For example, FIG. 2 is a schematic cross sectional view of a rotary blow out preventer, similar to the embodiments shown in U.S. Pat. No. 5,848,643, which is incorporated herein by reference. A rotating spindle assembly 48 is disposed within a non-rotating spindle assembly 50, which in turn, is disposed within a body 52 and held in position by lugs 54. To remove the entire non-rotating and rotating spindle assembly from the body 52, lugs 54 are rotated in horizontal grooves 56 and then lifted upwardly through vertical slots 58 in a "twist and lift" motion. However, the assembly can weigh about 1,500 to about 2,000 pounds and still requires use of extra lifting equipment such as the crane 26. In addition, disassembly of the drilling platform 38 is necessary to provide access and requires manual efforts by the drilling crew.

Similarly, U.S. Pat. No. 3,934,887, incorporated herein by reference, discloses a BOP body having an assembly of a lower stationary housing 22 and an upper stationary housing 24. The upper stationary housing 24 houses a stationary tapered bowl 60, a rotating bowl 62 disposed inwardly of the tapered bowl, and bearings 66, 68 disposed between the stationary bowl and rotating bowl. A stripper 40 is connected to the rotating bowl 62. A clamp 28 retains the assembly of the stationary tapered bowl 60, the rotating bowl 62, the bearings 66, 68, and associated equipment to the upper stationary housing 24. By unclamping the clamp 28, the entire assembly may be removed from the BOP body. However, the removable assembly is of such size and weight with the result that crews are needed below the drilling platform and lifting equipment is necessary to lift the assembly from the BOP body.

FIG. 3 is a schematic cross sectional view of another rotary BOP 60, similar to the embodiments disclosed in U.S. Pat. No. 4,825,938, incorporated herein by reference. To avoid removing the entire rotary BOP, the reference discloses a pneumatically actuated series of "dogs" 64 which engage a groove 66 on a retainer collar 68, referred to in that disclosure as "massive". By actuating pneumatic cylinders 70 to rotate the dogs 64 away from the groove 66, the "massive" retainer collar 68, the stinger 72, stinger flange 74, a stripper rubber 76, and associated bearing surfaces 78, 80 and 82 can be removed and access gained to the inner structures to repair or replace the stripper rubber 76. This device is similar to the preceding references in that both rotating and non-rotating portions are removed, which add weight and size to the assembly that is removed.

Another challenge to the rotary drilling head maintenance is bearing life. In a rotary BOP, bearings are used to reduce the friction between the fixed portions of the drilling head and the rotating drill string with rotating portions of the drilling head. As shown in FIG. 2, the typical assembly includes a lower bearing 84 and an upper bearing 86 axially disposed between a rotating portion 48 and a non-rotating portion 50 of the rotary BOP 50. The bearings are tightened in position, referred to as pre-loading the bearing, by typically turning a threaded bearing retainer 88 until the bearings are pre-loaded to a desired level. As the bearings wear or otherwise change, the loading changes. The BOP must be disassembled, the bearing readjusted, and the BOP reassembled. Otherwise, the bearings can fail prematurely, causing downtime for the drilling operations. Typically, the bearing retainer is directly inaccessible after assembly into the drilling head and the drilling head must be at least partially disassembled for readjustment.

There remains a need for an apparatus and method for decreasing the downtime in drilling an oil well by decreasing the time required for removal and replacement/repair of the packer and decreasing the time required to adjust the bearing loading.

SUMMARY OF THE INVENTION

The present invention generally provides an apparatus and method for sealing about a member inserted through a rotatable sealing element disposed in a drilling head. The rotatable sealing element is removable separately from non-rotating and/or other rotating portions. More specifically, the invention allows a rotatable packer in a drilling head to be removable separately from non-rotating and/or other rotating portions of the drilling head. The invention also provides a fluid actuated system to maintain a pre-load system on the bearing.

In one aspect, the invention provides a non-rotating portion, a first rotating portion and a second rotating portion, at least one rotating portion being rotatably engaged with the non-rotating portion, and a selectively disengageable retainer disposed adjacent at least one of the rotating portions and adapted to disengage at least one of the rotating portions from the non-rotating portion. In another aspect, the invention provides a non-rotating portion, a rotating portion disposed in proximity to the non-rotating portion, at least one bearing disposed between the non-rotating portion and the rotating portion and having at least one moveable bearing race adjacent a remaining portion of the bearing, and an actuator disposed adjacent the bearing race and adapted to adjust a position of the moveable bearing race relative to the remaining portion of the bearing. In another aspect, the invention provides a method of retaining a packer in a drilling head, comprising disposing a packer in a rotating portion of the drilling head, radially moving a retainer toward the packer, the retainer being at least partially disposed in the rotating portion, and radially engaging the packer with the retainer while maintaining a portion of the retainer in the rotating portion. In another aspect, the invention provides a non-rotating portion, a packer disposed within the non-rotating portion, a retainer ring radially disposed about the packer, and an annular piston radially disposed about the packer and aligned with the retainer ring. In another aspect, the invention provides a method of releasing a packer from a drilling head, comprising disengaging a retainer from a packer and removing a packer from the drilling head while retaining rotating portions of the drilling head with the drilling head. In another aspect, the invention provides a method of adjusting bearing pressure in a drilling head, comprising rotating a rotating portion relative to a non-rotating portion using at least one bearing disposed therebetween, pressurizing a fluid port in said non-rotating portion fluidicly connected to a bearing piston with a fluid, and actuating the bearing piston toward a moveable bearing race adjacent a remaining portion of the bearing.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DESCRIPTION OF THE PREFERRED EMBODIMENT

The present invention generally provides a removal system for a packer in a rotary drilling head and an adjustable loading system for bearing loads in the rotary drilling head. Preferably, the removal of the packer and adjustment of the bearing load can be done remotely through a hydraulic, pneumatic and/or electrical system external to the packer or bearing such as through a system mounted on the drilling head or a system distant from the drilling head itself.

Figure 1:
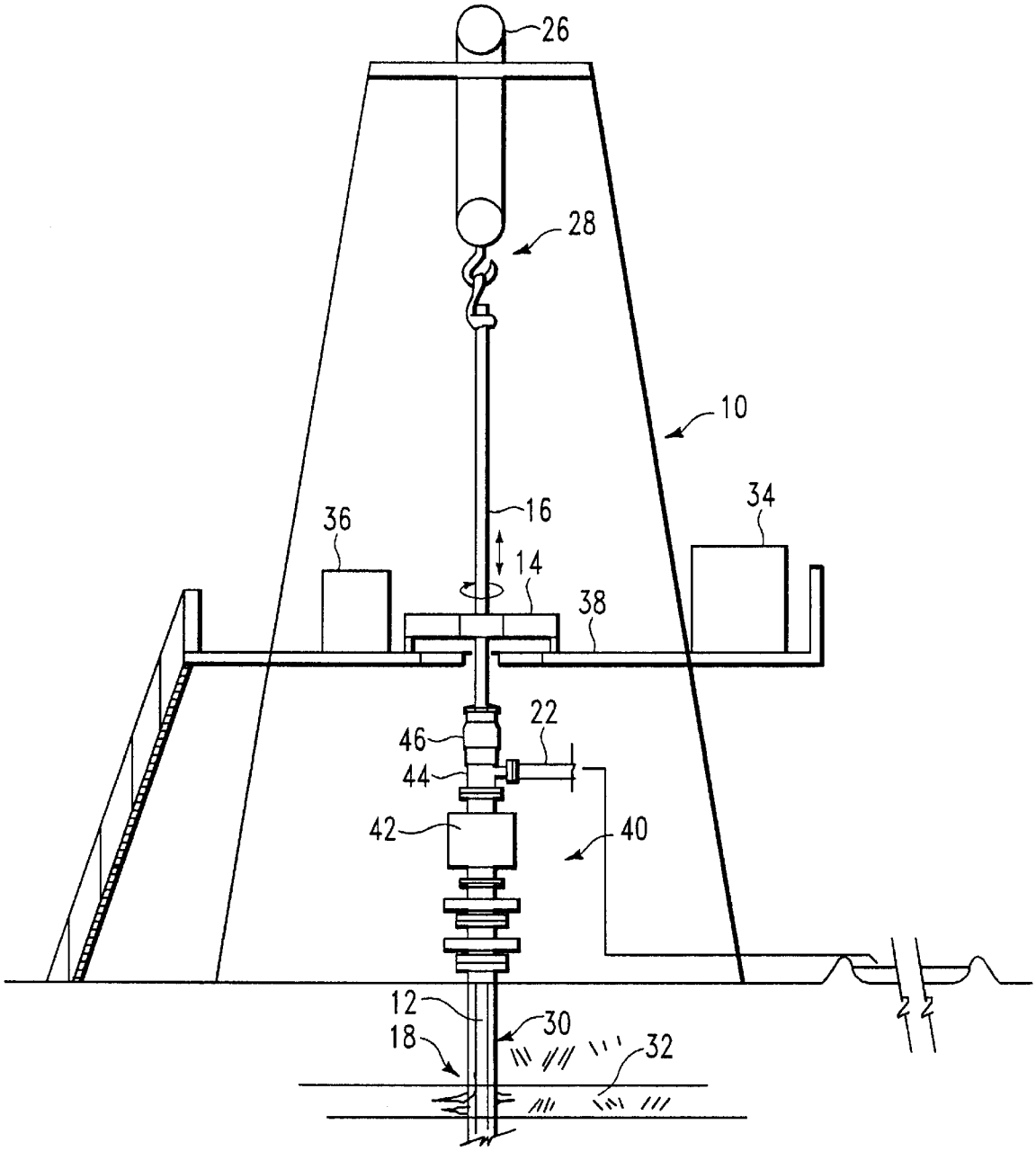
FIG. 1 is a schematic side view of a typical drilling rig.
Figure 2:
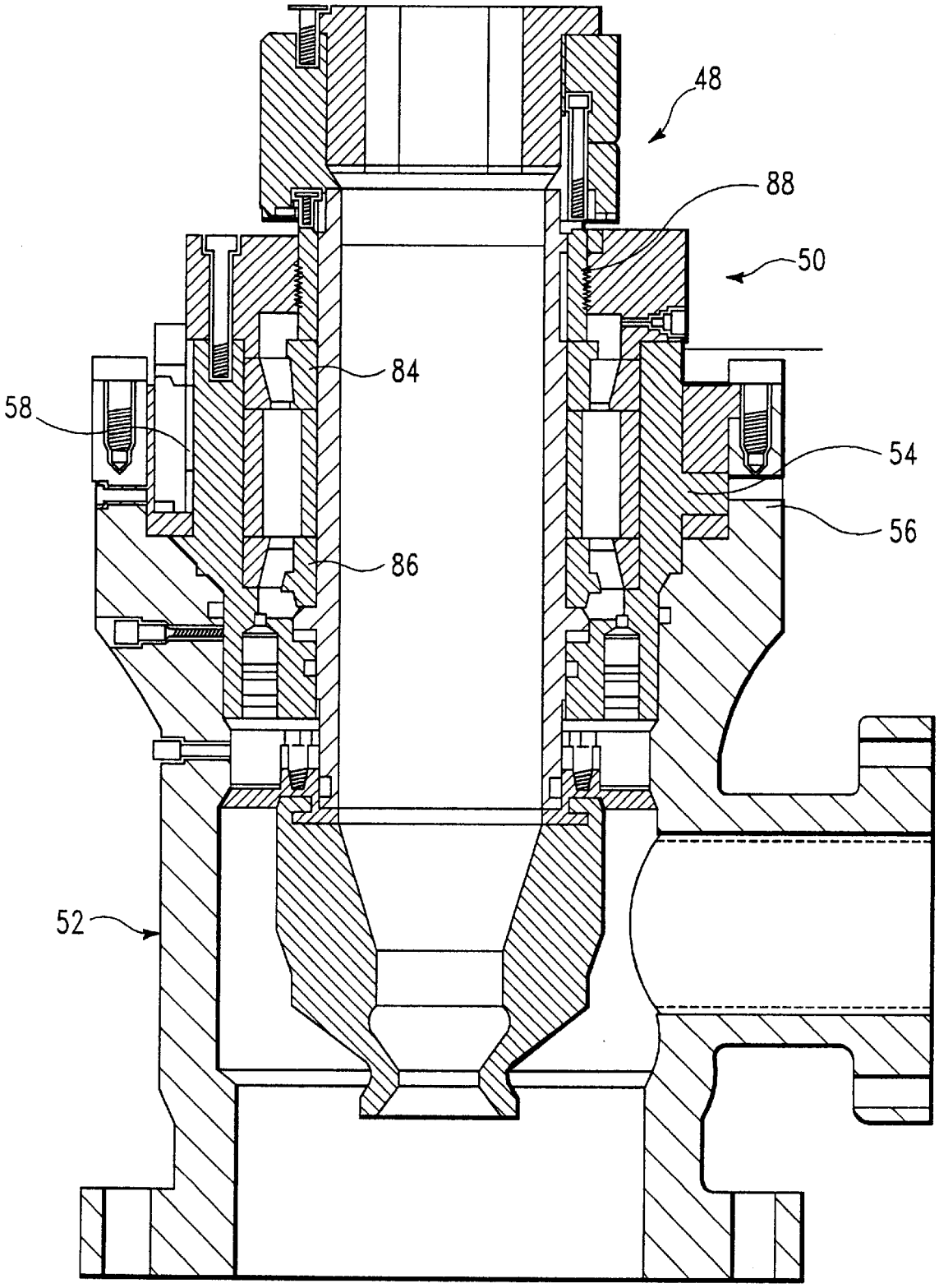
FIG. 2 (Prior Art)
FIG. 2 is a schematic cross sectional view of a prior art blow out preventer.
Figure 3:
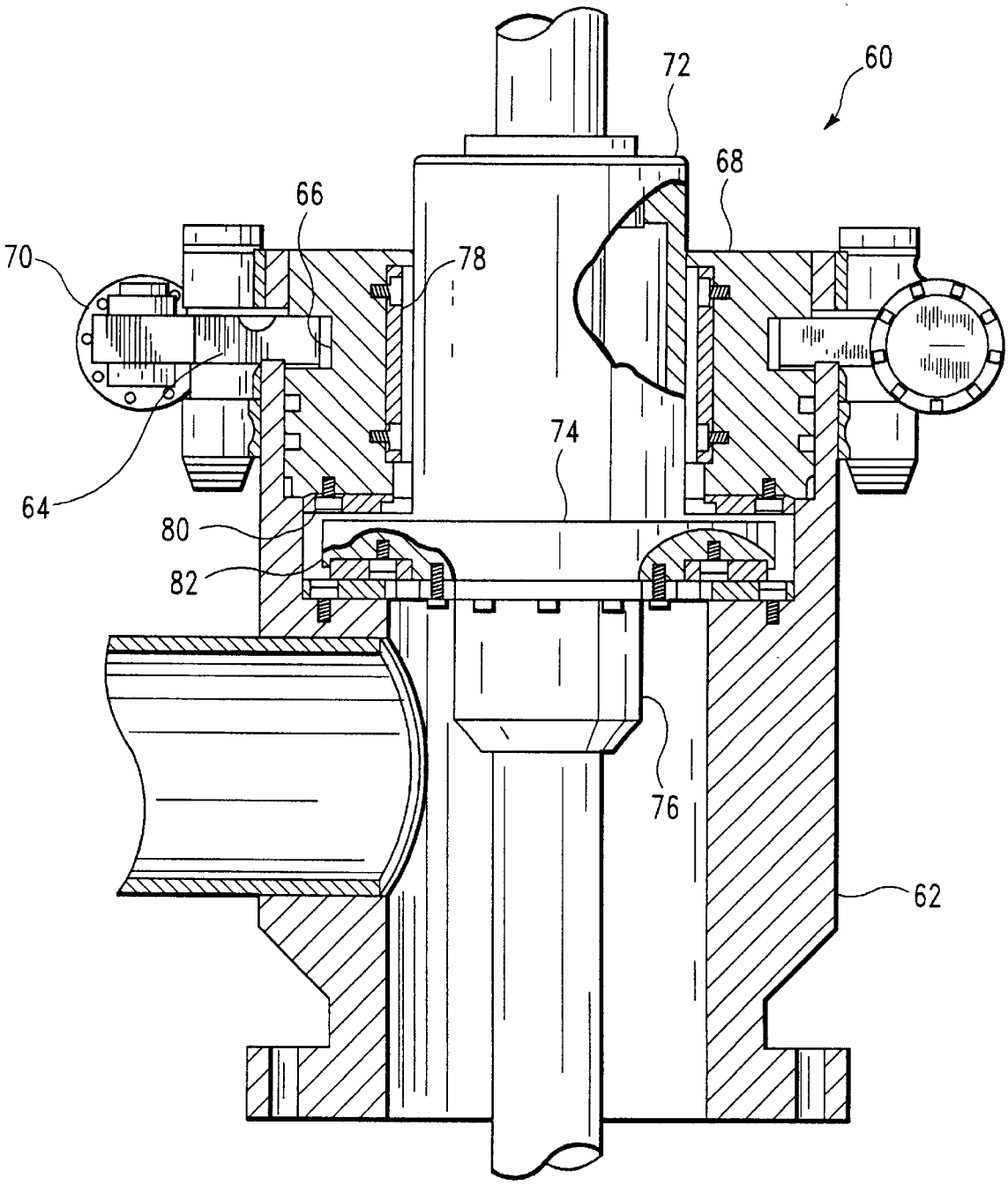
FIG. 3 (Prior Art)
FIG. 3 is a schematic cross sectional view of another prior art blow out preventer.
Figure 4:
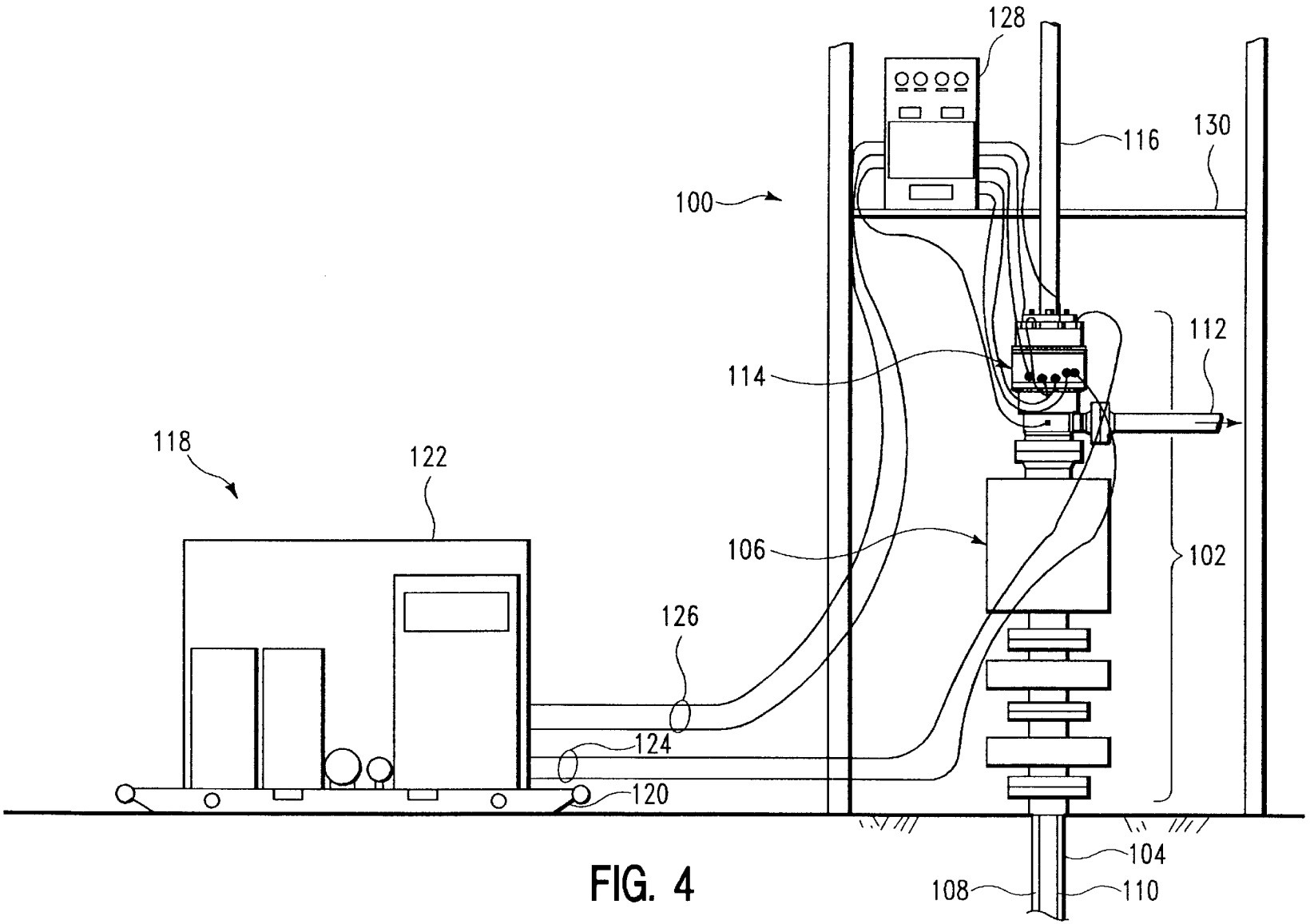
FIG. 4 is a schematic partial view of a drilling rig using the present invention.

FIG. 4 is a schematic partial view of a drilling rig 100 using the present invention. A stack 102 of flanged connections is located above the well 104 and connects one or more blow out preventers. An annular BOP 106 is disposed above the well in fluidic communication with the well drilling and production fluids. In the case of excess pressure in the well, the BOP will close the well and annular spaces 108 surrounding the drill string 110 in the well. Under normal conditions, the mud used to lubricate equipment in the well and flush drill shavings from a drill bit (not shown) is pumped through the outflow line 112 to mud pits (not shown). A rotary drilling head 114, also referred to as a rotary BOP, is mounted above the outflow line 112 and assists in sealing the drill string 110 as the drill string slides axially through the internal rotary drilling head surfaces, i.e., axially with respect to the longitudinal axis of the drill string. A kelly 116 is attached to the drill string 110 and is inserted into the rotary drilling head 114. The kelly 116 is typically hexagonal or square to transmit torque to rotatable portions of the drilling head 114 so that the rotatable portions rotate in conjunction with rotation of the drill string 110 and the kelly 116. A power unit 118 is mounted in proximity to the stack 102 and provides power to operate the rotary drilling head 114 and associated system equipment on the rig 10 through hydraulic, pneumatic, and/or electrical circuitry. The power unit 118 can be mounted on a skid 120 for portability. The power unit 118 typically houses pumps, valving, motors, and reservoirs for the system within an enclosure 122. In the embodiment shown, the system is simplified in that two pressure lines 124 travel to the rotary drilling head 112 and two pressure lines 126 travel to a control unit 128 mounted on the drilling platform 130. The control unit 128 houses valving, meters, gauges, and other equipment and is designed to control the pressure and flow from the power unit 118. While a hydraulic system is preferred, it is to be understood other systems such as pneumatic systems using gases, electrical systems and combinations thereof can also be used.

Figures 5, 5A, 5B:
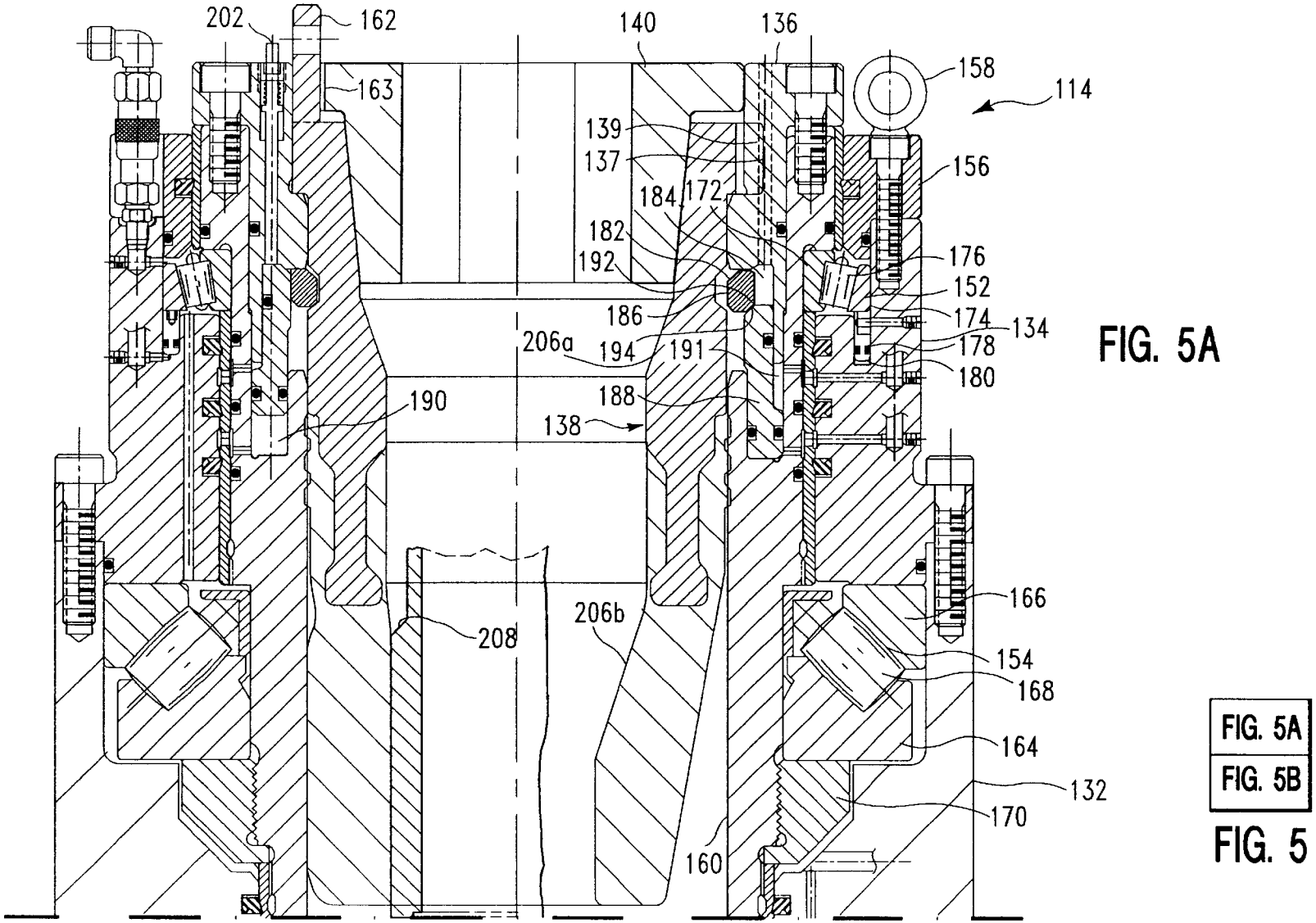
FIG. 5 is a schematic cross sectional view of one embodiment of a rotary drilling head, shown in split FIGS. 5A and 5B.
Figure 5B:
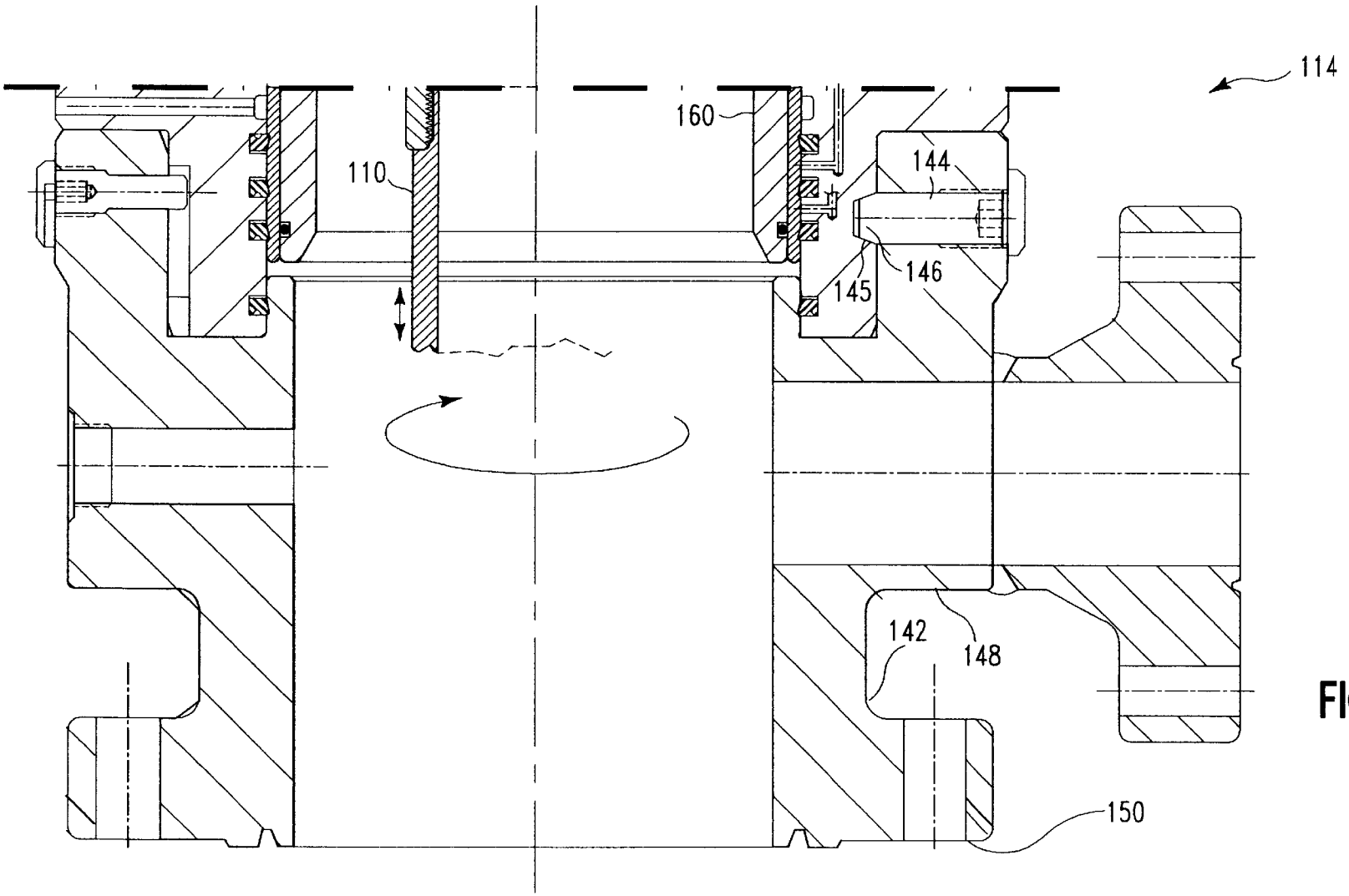

FIG. 5 shows a schematic cross sectional view of one embodiment of the drilling head 114. The right side of the figure shows the drilling head 114 in an unengaged state without a drill string 110 disposed therethrough and the left side shows the drilling head 114 engaged with a drill string 110 axially disposed therethrough. The main components of the drilling head 114 generally include an annular lower housing 132, an annular bearing housing 134, an annular upper housing 136, an annular packer 138, an annular drive bushing 140, a releasing element, such as a retainer ring 182, and an actuator for the releasing element, such as a main piston 188, and a lower body 142.

The lower housing 132 of the drilling head 114 is attached to an annular lower body 142 which can be attached to the stack 102, referred to in FIG. 4, through a flange 150 or other connection. Preferably, pins 144 are radially oriented about the circumference of the lower body 142 and engage recesses 146 on the lower housing 132. The recesses 146 preferably are conically tapered to receive and engage a taper 145 on the pins 144. The recesses 146 provide alignment between the lower housing 132 and the lower body 142. The pins 144 can also engage a radial groove extending around the lower housing, instead of individual recesses. The lower body 142 can also include the main overflow line 148.

The bearing housing 134 is attached to the lower housing 132 and engages an upper bearing 152 and a lower bearing 154. A cap 156 is attached to the upper surfaces of the bearing housing and seals the upper bearing 152 from dust and other contaminants. The cap 156 preferably has a plurality of lifting eyes 158. An inner housing 160 is disposed radially inward from the upper and lower bearings 152, 154 and engages the upper and lower bearings. The upper housing 136 is attached to the upper portion of the inner housing 160 and supports the packer 138 disposed inwardly of the upper housing 136.

Figures 8, 8A, 8B:
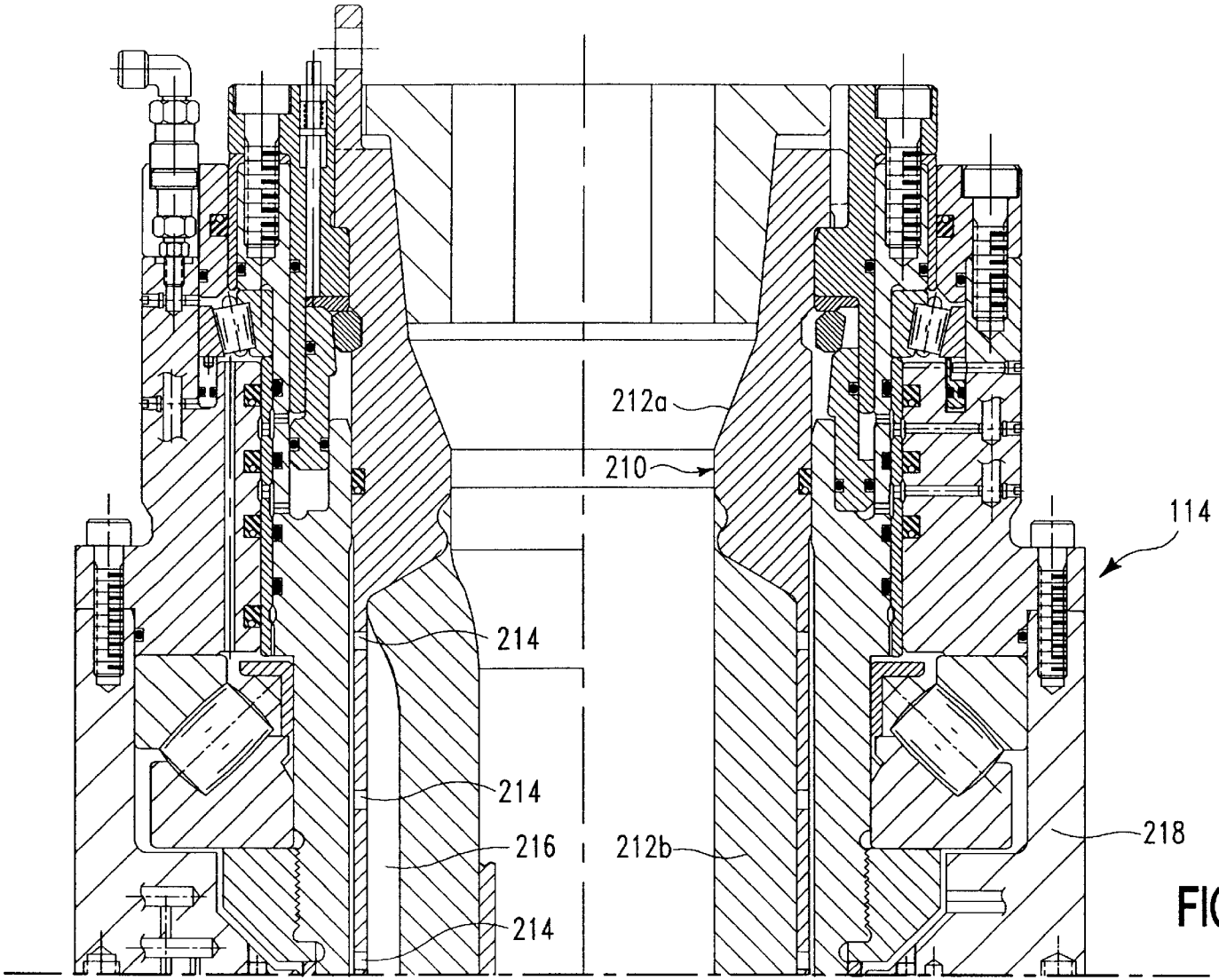
FIG. 8 is a schematic cross sectional view of another embodiment of the invention, shown in split FIGS. 8A and 8B.
Figure 8B:
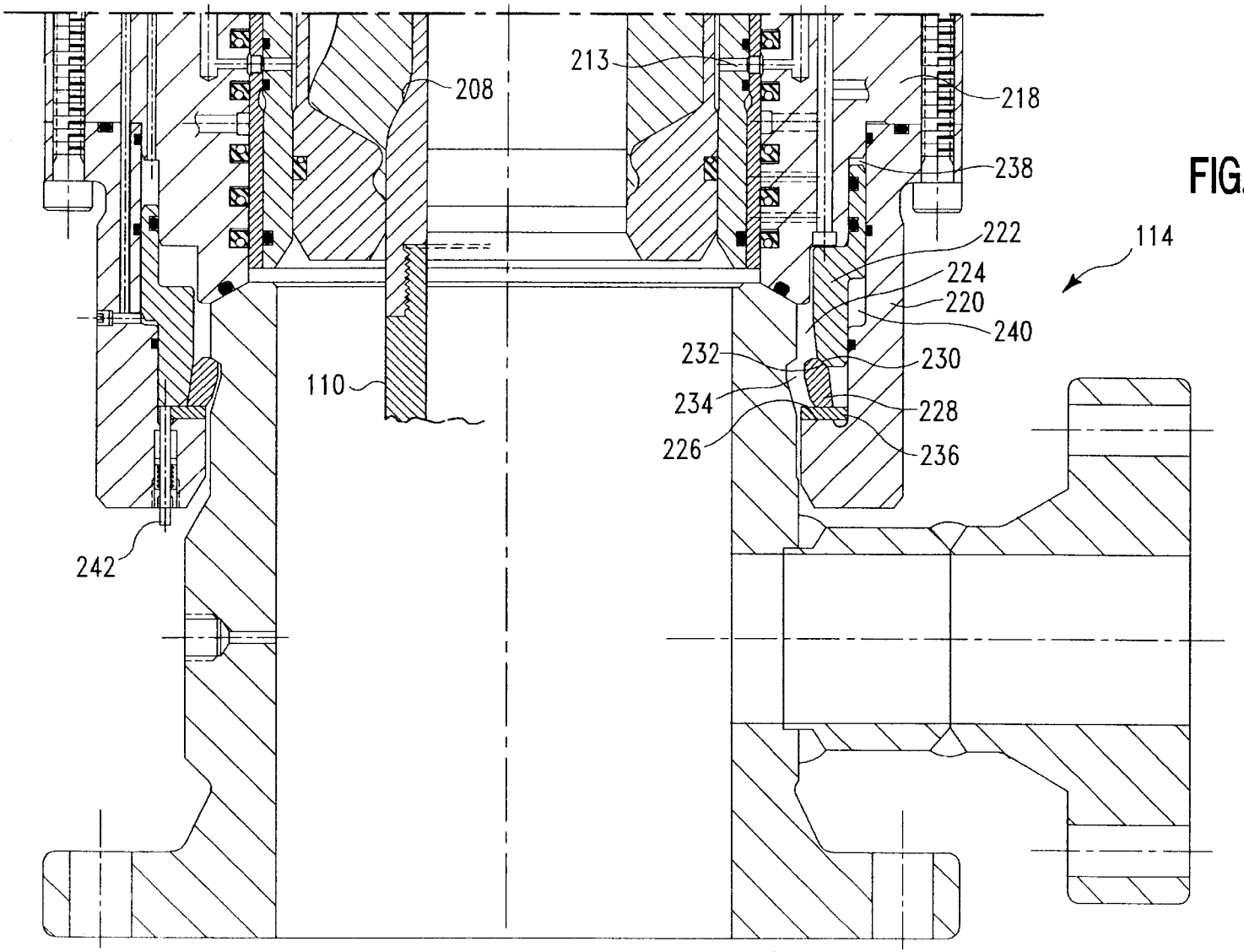

The packer 138 includes a mandrel 206*a*, which is an annular elongated metallic body, and an element 206*b* coupled to the mandrel, known as a "stripper rubber". The element 206*b* can be non-pressure assisted, as shown in FIG. 5, or pressure assisted, as shown in FIG. 8. The tubing string is inserted through the packer 138 and into the wellbore. The packer 138 is disposed inwardly from the upper housing 136 on an upper end of the packer and inwardly from the inner housing 160 on a lower end of the packer. The packer 138 is fixed in relative rotational alignment to the upper housing 136 and inner housing 160 by lugs 139 integral to or otherwise connected to the packer 138 that are disposed in axial slots 137 in the upper housing 136. The element 206*b* is made of elastomeric material such as rubber and is attached to the mandrel 206*a*, such as by molding, and forms a sealing surface for the drill string 110 as the drill string axially slides through the rotary drilling head 114. In an unengaged state, the element 206*b* preferably is molded to be biased toward the centerline of the packer 138. The element 206*b* can deflect as the drill string 110 and shoulders 208 at joints on the drill string 110 pass therethrough. The drive bushing 140 is disposed radially inward from the packer 138 and engages tabs 162 on the packer 138 with slots 163. A drive bushing 140 is not used in some instances when the drill string 110 is rotated without a kelly 116. In such instances, the packer 138 preferably has sufficient frictional contact with the drill string 110 to rotate with the drill string without using the drive bushing 140.

The upper bearing 152 comprises an inner race 172, an outer race 174, and a series of rollers 176 annularly disposed inside the bearing housing 134 and outside the inner housing 160. The outer race 174 engages the bearing housing 134 and the inner race 172 engages the inner housing 160. The upper bearing 152 is pre-loaded by a bearing actuator, such as an annular bearing piston 178, disposed in an annular cavity 180 in the bearing housing 134 axially adjacent the outer race 174 of the upper bearing 152. The bearing piston 178 engages the outer race 174 with pressure exerted from a hydraulic or pneumatic fluid applied to the bearing cavity 180 below the bearing piston 178 to move the outer race toward the rollers 176 and pre-load the upper bearing 152 and lower bearing 154. The pre-loading force can be monitored and maintained or selectively changed remotely without removing the bearings and associated housings by maintaining or adjusting the fluid pressure exerted on the bearing piston 178. Alternatively, a bias member (not shown) such as a spring can be used separately or in combination with the fluid pressure to pre-load the bearing. Such movements of the bearing race is deemed "remote" herein, in that the bearing race is moved by an additional member.

The lower bearing 154 likewise comprises an inner race 164, an outer race 166, and a series of rollers 168 annularly disposed inside the lower housing 132. The outer race 166 engages a bottom portion of the bearing housing 134 and the inner race 164 engages an outside portion of the inner housing 160. A lower bearing retainer 170 is threadably attached to the inner housing 160. When the bearing piston 178 moves upwardly and engages the outer race 174 of the upper bearing 152, the resulting force on the outer race 174 is transmitted through the upper bearing 152 to the inner housing 160 and tends to move the inner housing 160 upwardly. The inner race 164 on the lower bearing 154 moves upwardly with the inner housing 160 and exerts force on the rollers 168 of the lower bearing 154 to pre-load the lower bearing.

The combination of the lower and upper bearings allows axial and radial loads to be supported in the drilling head 114 as the drill string 110 is inserted therethrough and rotates the packer 138, the inner housing 160, the inner races 164, 172 and the rollers 168, 176. The outer races 166, 174, bearing housing 34, and lower housing 132 typically do not rotate. Lubricating fluid, such as hydraulic fluid, preferably is pumped through each bearing 152, 154 to lubricate and wash contaminants from the bearings.

An annular retainer ring 182 is disposed in an annular ring cavity 184 formed between an upper portion of the inner housing 160 and a lower portion of the upper housing 136. The retainer ring 182 is radially aligned with an annular groove 186 on the outside of the packer 138 and inward of the retainer ring 182. Preferably, the retainer ring is "C-shaped" and can be compressed to a smaller diameter for engagement with the groove 186. Preferably, in a radially uncompressed state, the retainer ring 182 does not engage the groove 186 and the packer can be removed. An annular main piston 188 is disposed in a lower cavity 190 in the inner housing 160 and protrudes into the ring cavity 184. The main piston 188 is axially aligned in an offset manner from the retainer ring 182 by an amount sufficient to engage a tapered surface 192 on the outside periphery of the retainer ring 182 with a corresponding tapered surface 194 on the inside periphery of the main piston 188. The main piston is connected to various fluid passageways for actuation. The retainer ring 182 has a cross section sufficient to engage the groove 186 and still protrude into the ring cavity 184 so as to limit the axial travel of the packer 138 by abutting the lower end of the upper housing 136 and the upper end of the main piston 188. A bias member (not shown) can be disposed axially adjacent the end of the main piston 188 that is distant from the retainer ring 182 to provide an axial force to the main piston and pre-load the piston against the retainer ring. The bias member can be, for example, a spring, pressurized diaphragm or tubular member, or other biasing elements. An upper cavity 191 is disposed between the main piston 188 and the upper housing 136 and is separate from the ring cavity 184. An indicator pin 202 is disposed in the upper housing 136. On the lower end of the indicator pin 202, the pin engages the upper end of the main piston 188. The upper end of the indicator pin 202 is disposed outside the upper housing 136, when the main piston 188 is disposed upwardly in the ring cavity 184.

An assortment of seals are used between the various elements described herein, such as wiper seals and O-rings, known to those with ordinary skill in the art. For instance, each piston preferably has an inner and outer seal to allow fluid pressure to build up and force the piston in the direction of the force. Likewise, where fluid passes between the various housings such as the pistons, seals can be used to seal the joints and retain the fluid from leaking.

Figure 6:
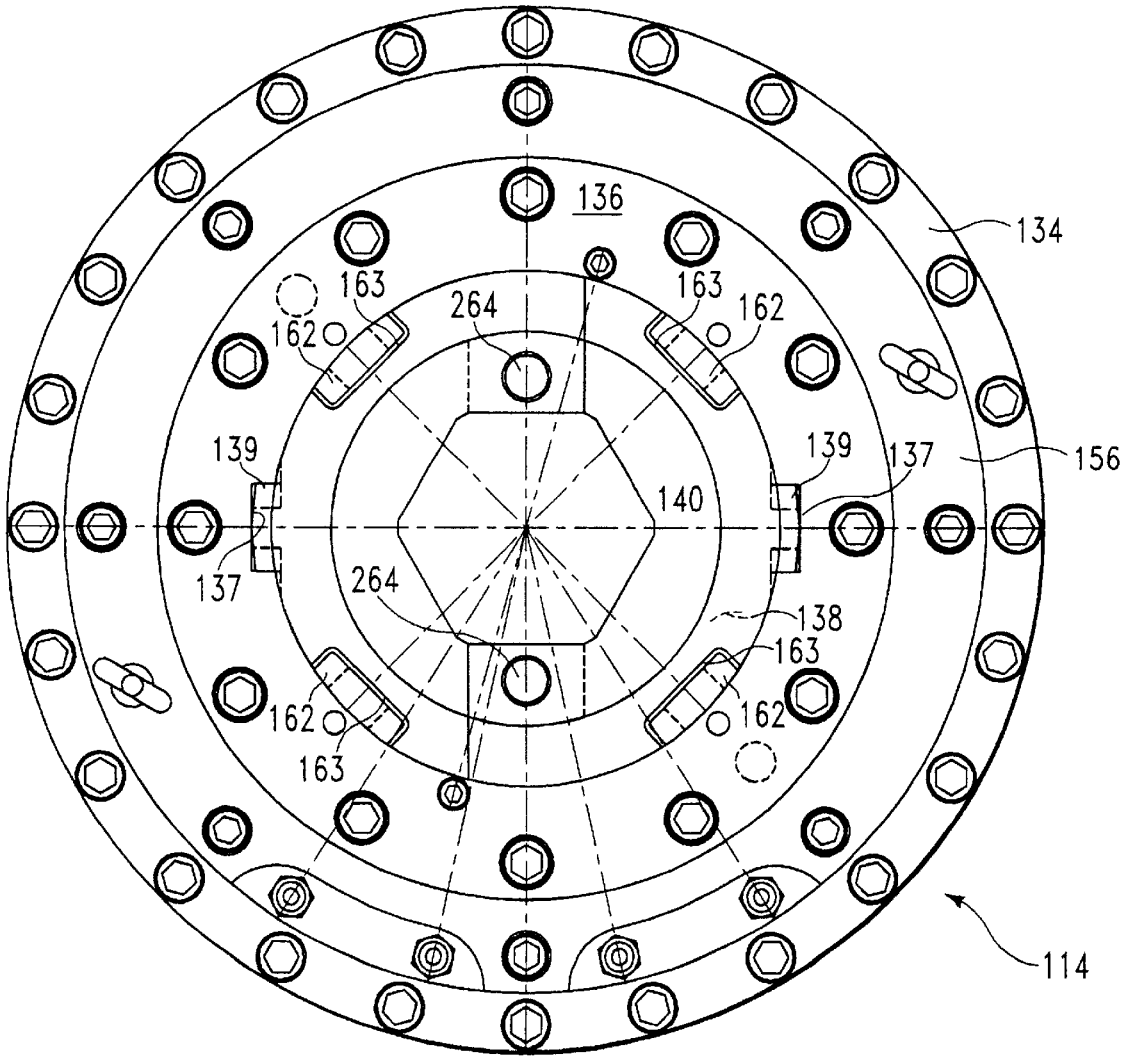
FIG. 6 is a schematic top view of the embodiment of FIG. 5.

FIG. 6 is a schematic top view of the drilling head shown in FIG. 5. The bearing housing 134 is circumferentially bolted to the lower housing (not shown) and the cap 156 is circumferentially bolted to the bearing housing 134. The upper housing 136 is disposed radially inward of the cap 156 and is circumferentially bolted to the inner housing (not shown). The upper housing 136 includes two slots 137 in which lugs 139 on the packer 138 are inserted to maintain the relative rotational position of the packer 138 with the upper housing 136 and inner housing 160. The drive bushing 140 is disposed radially inward of the packer 138, is supported axially by the packer, and is radially fixed in position relative to the packer 138 by the slots 163 on the drive bushing when engaged with the tabs 162 on the packer 138.

Figure 7:
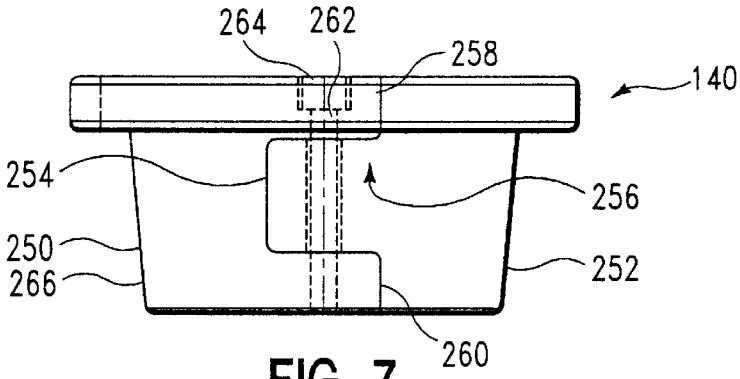
FIG. 7 is a schematic side view of a drive bushing.

FIG. 7 is a schematic side view of the drive bushing 140. The drive bushing 140 is designed to mate in two or more symmetrical portions 250, 252. Each symmetrical portion includes a tab 254 and a slot 256 on opposing sides formed between two or more flanges 258, 260, and bolt holes 262 through which bolts 264 are inserted through adjacent symmetrical portions, including the tabs and slots, to retain the symmetrical portions together. The bolts holes 262 are disposed axially, so that if the bolts 264 should be loosened in operation, the bolts would remain in place and the symmetrical portions 250, 252 be retained together in contrast to a typical radial alignment for the bolts in which loose bolts could be thrown away from an assembled bushing by centrifugal force. The drive bushing 140 has an annular tapered surface 266 to mate with a corresponding tapered surface in the packer 138, referenced in FIG. 6, and assist in securing the drive bushing axially in the packer.

In operation, referencing FIGS. 4–7, a crane 26 lifts the rotary drilling head 114 onto the stack 102 and the lower body 142 is attached to the stack with bolts in the flange 150. One or more pins 144 in the lower body 142 engage the recesses 146 to secure both the axial and rotational positions of remaining portions of the drilling head 114, i.e., those portions of the drilling head detachable from the lower body. Alternatively, the lower body 142 can be attached separately to the stack 102 and the remaining portions of the drilling head 114 attached to the lower body 142 with pins 144. Fluid, such as hydraulic fluid(s) or pneumatic gas(es), is pumped into the drilling head 114 by the power unit 118 and controlled by the control unit 128. To engage the retainer ring 182 with the groove 186, the fluid is pumped into the lower cavity 190 and axially displaces the main piston 188 into engagement with the retainer ring 182 to force the ring radially inward. The engaged position of the retainer ring 182 with the groove 186 is shown on the left side of FIG. 5. The force exerted between the tapers 192, 194 compresses the retainer ring 182 radially inward to engage the groove 186. The indicator pin 202 is pushed outward from the upper housing 136 by the travel of the main piston 188 to indicate the groove 186 is engaged. An assembly (not shown) can be bolted to the upper housing 136 to manually force the indicator pin 202 back into the upper housing 136, thereby forcing the main piston 188 away from the retainer ring 182 to manually release the packer 138 if desired. Thus, the packer 138, as a first rotating portion, is releasably retained in the drilling head 114 by the retainer ring 182. Additionally, the fluid pressure can be maintained on the piston 188 even while the inner housing 160 and upper housing 136 rotate within the bearing housing 134 by the several seals, such as wiper seals and O-rings, located between non-rotating portions and other rotating portions of the drilling head, such as between the bearing housing 134 and the upper housing 136 or the inner housing 160.

A drill string 110, drilling bit (not shown), and a kelly 116 are assembled and inserted through the drive bushing 140 and the packer 138. The element **206*b* deflects radially outward as the drill string 110 is axially forced through the packer 138 and effects a seal about the periphery of the drill string. The kelly 116 is rotated which rotates the drill string, the drilling bit, and rotating components of the drilling head 114** for drilling a well.

When the packer 138 and particularly the element **206*b* is to be replaced, the retainer ring 182 expands radially outward to disengage the packer 138 from the drilling head 114. Fluid is forced into the upper cavity 191 and axially forces the main piston 188 away from the retainer ring 182, whereupon the retainer ring decompresses radially outward and disengages the groove 186, thereby releasing the packer from the non-rotating portions and other rotating portions. A pipe joint on the drill string 110 is separated and the upper portion of the drill string is removed from the drilling head 114. Because of the relatively light weight of the packer 138 compared to the assembly of rotating components and especially compared to the entire drilling head 114, neither the crane 26 nor special equipment may be needed to connect to the packer 138 and pull it from the drilling head 114. The crane 26 may simply lift the drill string 110 and the element 206*b* can rest on the pipe shoulder 208 and pull the packer 138 with the drill string 110. The bearings 152, 154, upper housing 136, inner housing 160, cap 156, bearing housing 134, and lower housing 132, all can remain attached to the lower body 142**.

The packer 138 may be reinserted into the drilling head 114 in the opposite manner. The packer 138 is placed on the drilling head 114 and rotated until the lugs 139 on the packer 138 are aligned with the slots 137 in the upper housing 136 and the packer then slides axially into position. The drive bushing 140, if not already installed, is placed over the packer 138, the slots 163 are aligned with the tabs 162 on the packer 138, and the drive bushing is slid into position. The fluid pressure in the upper cavity 191 can be released and the fluid pressure in the lower cavity 190 forces the main piston 188 into engagement with the retainer ring 182. The retainer ring 182 compresses radially inward and engages the groove 186. The packer is thus secured and operations can be resumed.

FIG. 8 is a schematic cross sectional view of another embodiment of the drilling head. The embodiment shows two primary changes where one is to the packer 210 and the other to the manner in which the remaining portions of the drilling head 114 are retained to the lower body 142. Any of the changes could be used with other embodiments and is not limited to the embodiment shown. In this embodiment, the other portions of the drilling head 114 remain substantially unchanged. The packer 210 includes a mandrel 212*a* and a pressure assisted element 212*b* is disposed radially inward from the mandrel and is axially bound by the mandrel on either end of the pressure assisted element. The pressure assisted element 212*b* is shown in an unengaged mode on the right side of the centerline in FIG. 8 and in an engaged mode with a drill string 110 on the left side of FIG. 8. A port(s) 214 is disposed through the sidewall of the packer 210 radially outward from the pressure assisted element 212*b* and is connected to fluid passageway(s) 213 leading to the power unit 118 and control unit 128, referenced in FIG. 4. A drill string 110 having a shoulder 208 at each typical pipe joint is axially disposed through the drilling head 114 on the left side of the centerline. A cavity 216 in the engaged position shown on the left side of FIG. 8 is formed when fluid pressure forces the pressure assisted element 212*b* toward the drill string 110. The pressure assisted element assists in conforming the packer to variations in size and/or shape of different portions of the drill string, such as shoulder 208, as the drill string is inserted through the drilling head.

An annular lower housing 218 is attached to an annular piston housing 220 disposed below the lower housing. An annular lower main piston 222 is disposed radially inward of the piston housing 220 and is housed in a lower ring cavity 224 formed between the lower end of the lower housing 218, the inner periphery of the piston housing 220, and a shoulder 226 of the piston housing 220. A lower retainer ring 228 is disposed in the lower ring cavity 224 similar to the retainer ring 182. The lower main piston 222 is axially aligned with the lower retainer ring 228 in an offset manner and engages the lower retainer ring 228 between tapered surfaces 230, 232. A lower groove 234 is formed on the outside circumference of the lower body 142 and is radially aligned with the lower retainer ring 228. A wear ring 236 is disposed axially adjacent and below the lower retainer ring 228. An upper cavity 238 is formed between the lower main piston 222 and a lower end of the lower housing 218. A lower cavity 240 is formed between the lower main piston 222 and the piston housing 220. A lower indicator pin 242, similar to the indicator pin 202, referenced in FIG. 5, is axially disposed in the piston housing 220 and aligned with the lower main piston 222.

In operation, the remaining portions of the drilling head 114 can be inserted over the lower body 142. Fluid is forced into the upper cavity 238 and applies pressure to the lower main piston 222. The lower main piston slides axially and engages the lower retainer ring 228 between the tapered surfaces 230, 232, thereby radially compressing the lower retainer ring 228 into the groove 234. The remaining portions of the drilling head 114 are thus secured to the lower body 142. The lower main piston 222 forces the lower indicator pin 242 axially outward from the piston housing 220, indicating an engaged mode. If the remaining portions of the drilling head 114 should need removal from the lower body 142, fluid is forced into the lower cavity 240, thereby axially displacing the lower main piston 222 away from the lower retainer ring 228. The lower retainer ring 228 radially decompresses, disengages from the groove 234 on the lower body 142 and releases the remaining portions of the drilling head 114 for removal.

Furthermore, in operation, a drill string is inserted through the drilling head 114 and axially slides by the packer 210. Fluid is transported through the port(s) 214 and expands the cavity 216 which in turn forces the pressure assisted element 212*b* to radially compress against the drill string 110. The amount of radial compression on the drill string can be controlled such as by regulating the pressure in the cavity 216.

Figure 9:
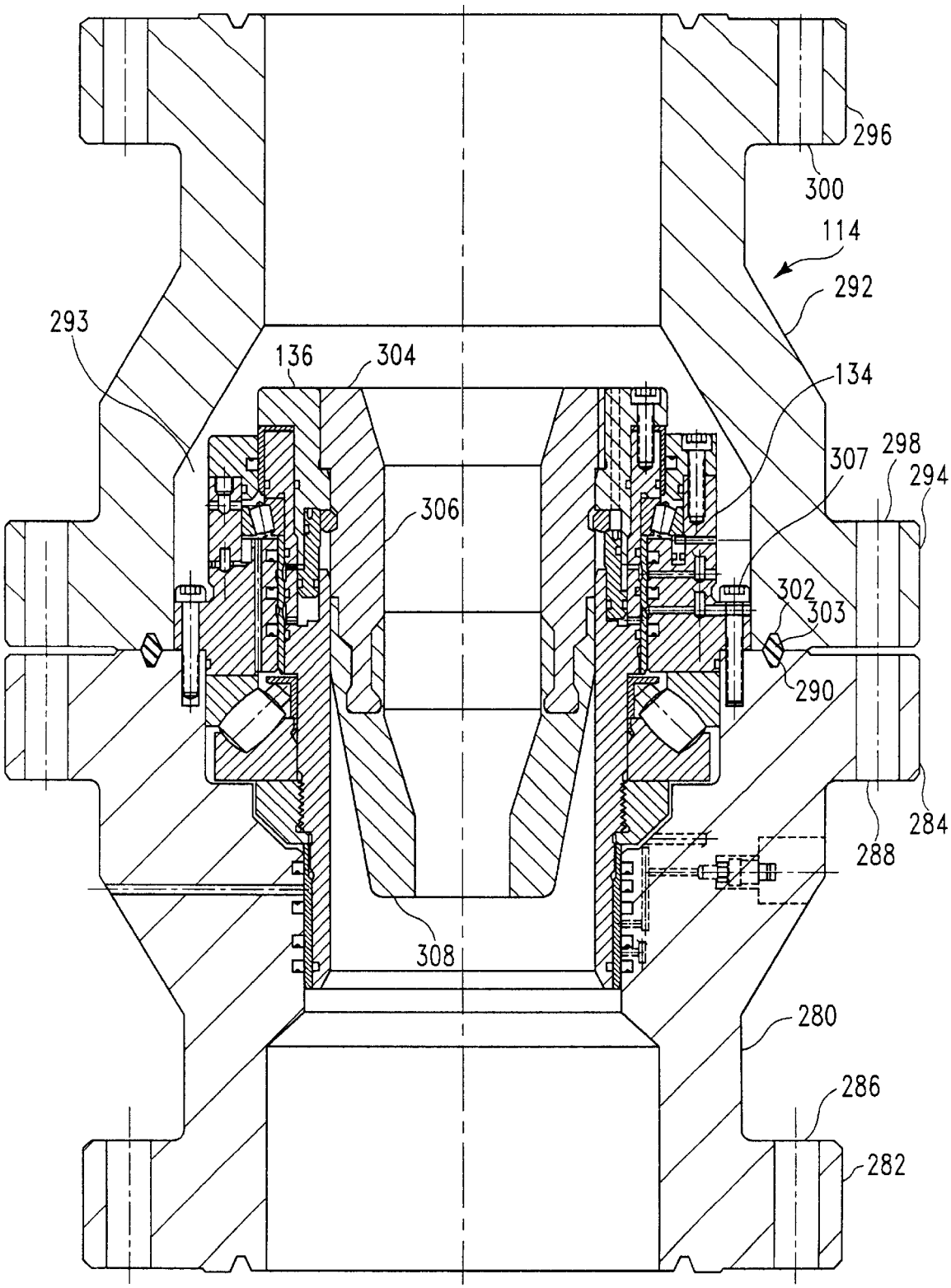
FIG. 9 is a cross sectional schematic view of another embodiment of the drilling head.

FIG. 9 is a cross sectional schematic view of another embodiment of the drilling head 114. A lower body 280 generally houses the various rotating and non-rotating elements described in reference to the embodiment shown in FIG. 5. The lower body 280 includes an attachment member, such as a flange 282, which defines connecting holes 286 for bolts or other fasteners to pass therethrough into a mating flange (not shown) such as a flange disposed at the top of a well head casing. The lower body 280 also includes an attachment member, such as a flange 284, which defines connecting holes 288 for bolts or other fasteners to pass therethrough for connecting the lower body 280 to a mating flange 294 on an upper body 292. The upper body 292 is mounted to the lower body 280 in a sealing relationship with the flanges 284, 294 and covers the various rotating and non-rotating members housed by the lower body 280. The upper body also includes an upper flange 296 which defines holes 300 for bolts or other fasteners to pass therethrough into a mating flange (not shown), such as a flange disposed at the bottom of a casing extending downward from a drilling platform. The flange 284 of the lower body defines a lower body seal groove 290 and the flange 294 of the upper body defines an upper body seal groove 302. The seal grooves 290, 302 are sized and spaced in a cooperative relationship so that a seal 303 can be disposed therebetween to effect a seal between the flanges. Generally, the upper body and the lower body form an enclosure in connection with adjoining structure for protecting the bearings and packer of the drilling head from a radially external medium such as corrosive fluids, dirt, and other contaminates.

In general, various rotating and non-rotating members of the drilling head are disposed in a cavity 293 formed by the upper body 292 and lower body 280. For example, the bearing housing 134 is mounted to the lower housing 280 by a fastening member 307, such as one or more bolts, snap rings or other known fastening members, disposed within the cavity 293. The fastening member 307 can also be an arrangement similar to the retainer ring 182 and main piston 188, shown in FIGS. 5 and 8, that could engage the bearing housing 134 to the lower body 280 or the upper body 292. The piston could be remotely actuated so that the bearing housing could be selectively fastened or released. A remote release or fastening could be particularly useful in remote locations such as in subsea applications. A packer 304, similar to the packer 138, is disposed within the drilling head 114 inward of an annular upper housing 136. The packer 304 may extend upward to the elevation of the annular upper housing 136. The packer 304 includes a mandrel 306 and an element 308, similar to the mandrel 206*a* and element 206*b*, respectively, shown in FIG. 5. The packer 304 is at least partially disposed in a cavity formed between the upper body 292 and the lower body 280.

Figure 10:
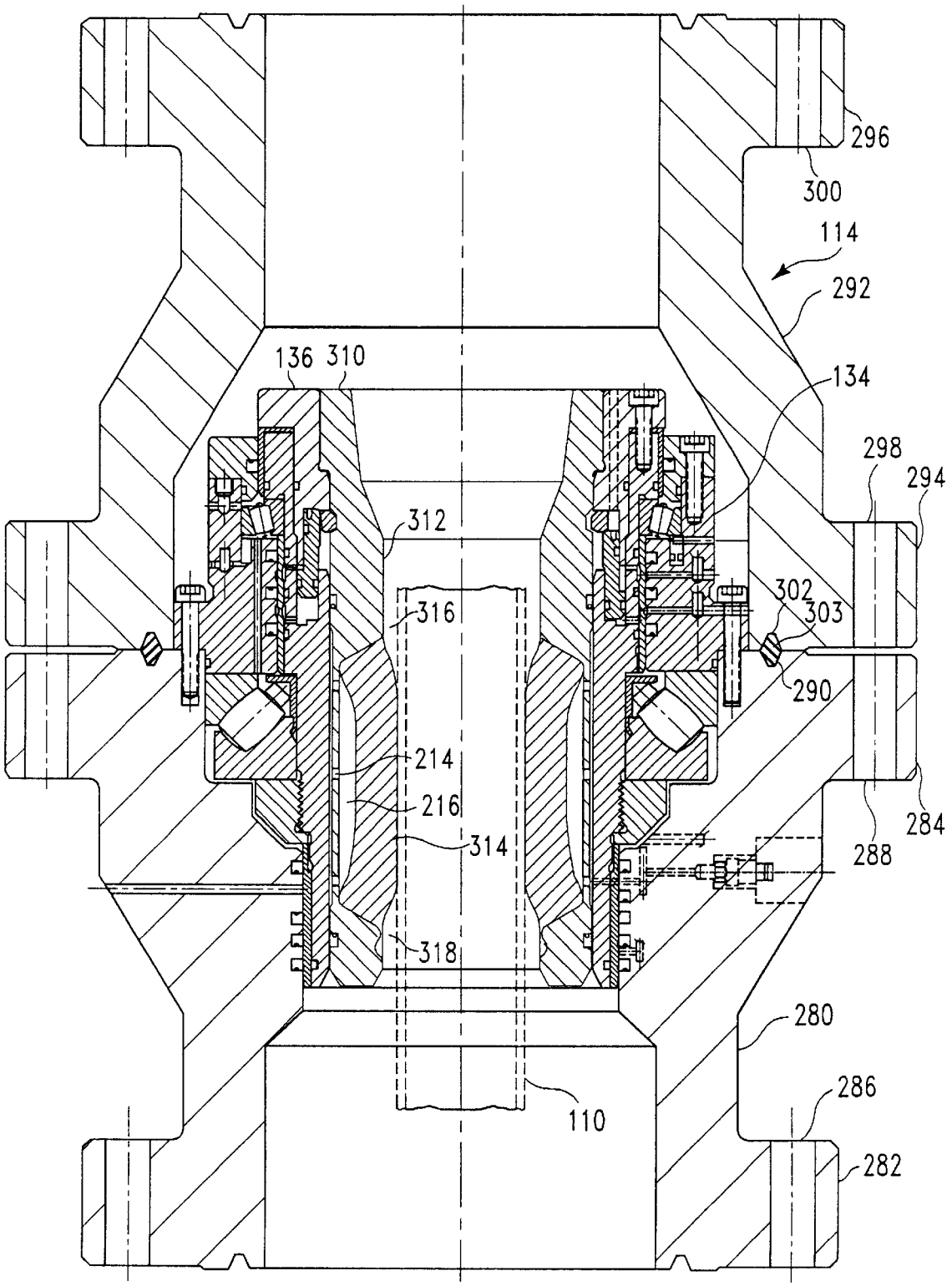
FIG. 10 is a cross sectional schematic view of another embodiment of the drilling head.

FIG. 10 is a cross sectional schematic view of another embodiment of the drilling head 114, having members similar to those described in the embodiment shown in FIG. 8. The lower body 280 includes a flange 282 which defines connecting holes 286 for bolts or other fasteners to pass therethrough into a mating flange (not shown) on an adjacent structure. The lower body 280 also includes a flange 284 which defines connecting holes 288 for bolts or other fasteners to pass therethrough for connecting the lower body 280 to a mating flange 294 on an upper body 292. The upper body 292 is mounted to the lower body 280 in a sealing relationship with the flanges 284, 294 and covers the various rotating and non-rotating members housed by the lower body 280. The upper body also includes an upper flange 296 which defines holes 300 for bolts or other fasteners to pass therethrough into a mating flange (not shown) on an adjacent structure. The flange 284 of the lower body defines a lower body seal groove 290 and the flange 294 of the upper body defines an upper body seal groove 302. The seal grooves 290, 302 are sized and spaced in a cooperative relationship so that a seal 303 can be disposed therebetween to effect a seal between the flanges.

A packer 310 is disposed annularly within the annular upper housing 136. The packer 310 includes a mandrel 312 and a pressure assisted element 314 that is disposed radially inward from the mandrel. The pressure assisted element 314 is axially bound by the mandrel on either end of the element. The pressure assisted element 314 is shown in an engaged mode with a drill string 110 that is axially disposed through the drilling head 114. A port(s) 214 is disposed through the sidewall of the packer 310 radially outward from the pressure assisted element 314 and is fluidicly connected to a fluid pressure source. A cavity 216 is formed when fluid pressure forces the pressure assisted element 314 toward the drill string 110. The pressure assisted element 314 assists in conforming the packer 310 to variations in size and/or shape of different portions of the drill string 110 as the drill string is inserted through the drilling head. The pressure assisted element 314 seals against the drill string 110 and allows differences in pressure between a first zone 316 and a second zone 318 for independent control of the pressures in the zones as described below.

Figure 11:
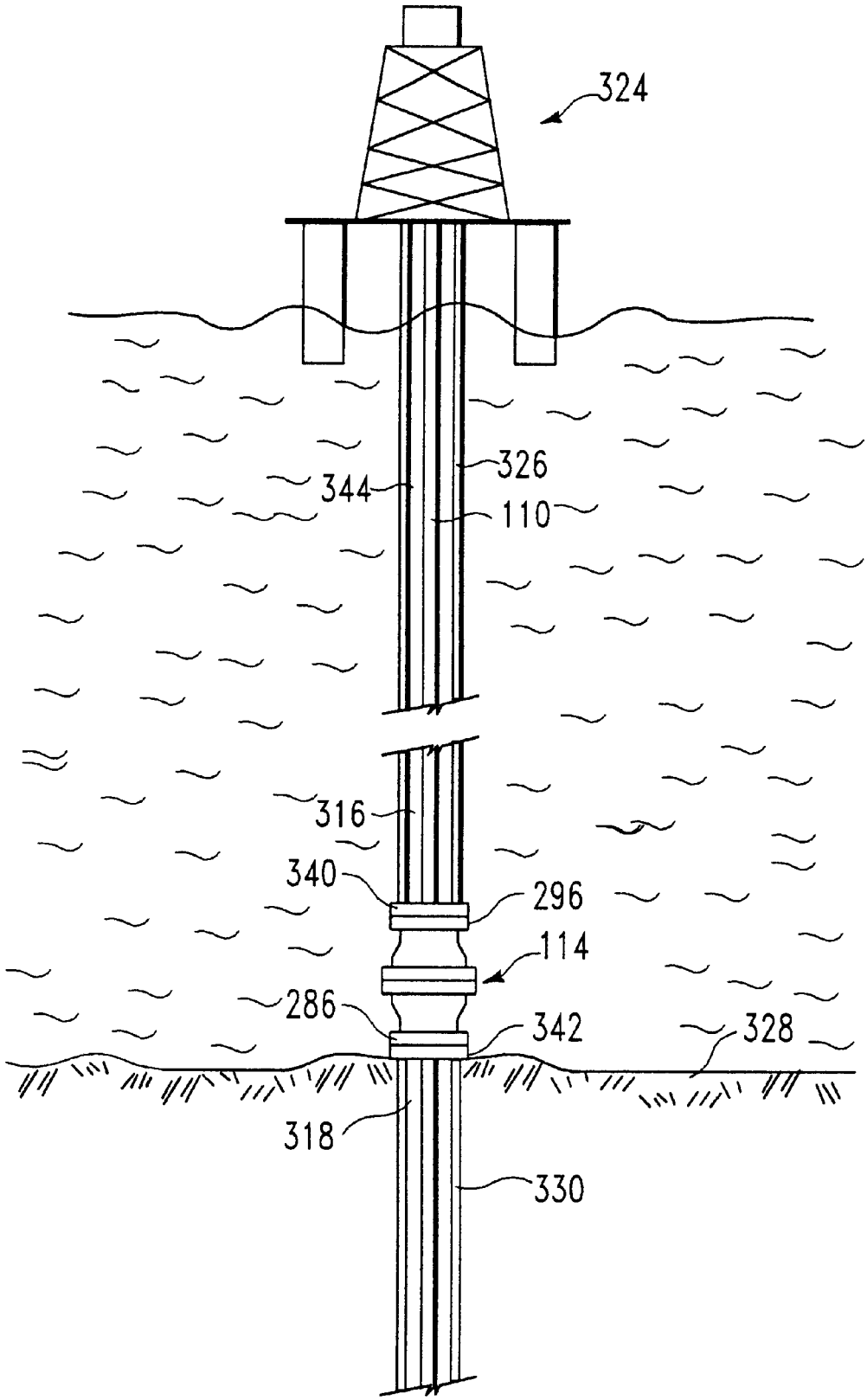
FIG. 11 is a partial cross sectional schematic of a subsea wellbore with a drilling platform disposed thereover.

FIG. 11 is a partial cross sectional schematic of a subsea wellbore 330 with a drilling platform 324 disposed thereover. The flanged embodiments shown in FIGS. 9 and 10 can be used in such an application. A casing 326 is suspended from the drilling platform 324 and extends a distance from the drilling platform to near the sea floor 328. A drill string 110 is disposed within the casing so that an annular space 344 is formed therebetween. A flange 340 is connected to the lower end of the casing. A flanged drilling head 114 is sealingly connected to the flange 340 with a flange 296 disposed on the top surfaces of the drilling head. Similarly, a flange 286 disposed on the bottom surfaces of the drilling head 114 is sealingly connected with a flange 342 disposed on top of the wellbore 330.

As the casing increases in depth, the weight of the water increases the pressure on the external surface of the casing. A sufficiently high pressure can distort or collapse the casing. A counteracting pressure within the annular space 344 in the casing can offset the effects of the external water pressure and minimize pressure differences. For example, the pressure differences can be minimized by flowing a fluid of similar density as sea water into the annular space to lessen the pressure gradient between the internal and external surfaces of the casing.

However, pressures necessary to drill into a subsea formation in the wellbore 330 may necessitate different pressures than those pressures required to offset the water pressure on the casing 326. A drilling head 114, such as the embodiment shown in FIG. 10, can be mounted between the casing and the wellbore. The pressure assisted packer 310 engages the drill string 110 and creates a first zone 316 above the packer 310 and a second zone 318 below the packer. A first set of pressures can be controlled in the first zone 316 to offset the pressures from the water as the casing increases in depth. A second set of pressures can be controlled in the second zone 318 to enable effective drilling into the various formations and production zones.

Figure 12:
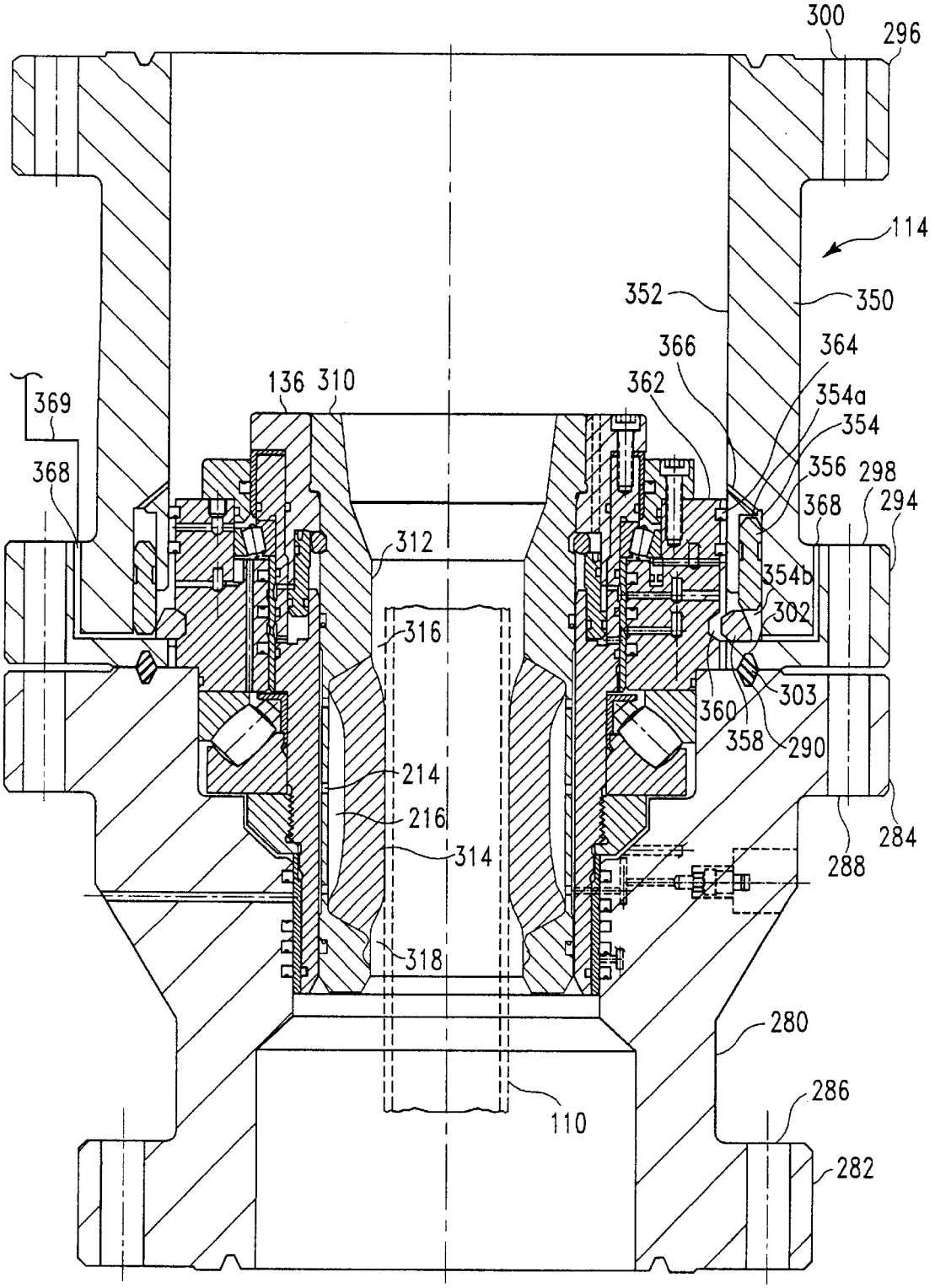
FIG. 12 is a cross sectional schematic view of another embodiment of the drilling head.

FIG. 12 is a cross sectional schematic view of another embodiment of the drilling head 114, having members similar to those described in the embodiment shown in FIGS. 9 and 10. An upper body 350 is coupled to a lower body 280 with flanges 284, 294 or other coupling members. Alternatively, the upper body 350 and the lower body 280 can be made as a unit with or without the flanges. A bearing housing 362, similar to bearing housing 134 shown in FIGS. 9 and 10, is removably coupled to the upper body 350 and/or the lower body 280. An upper housing 136 is disposed radially inward of the bearing housing 362. A packer 310 is disposed radially inward of the upper housing 136. A throat 352 of the upper body 350 is sized to allow the bearing housing 362 and related members to be disconnected from the upper or lower body and be retrieved therethrough.

One system for coupling the bearing housing 362 is similar to the system of a fastening member such as a retainer ring 186 and a piston 188, shown in FIGS. 5 and 8–10. As an example, the upper body 350 can include an annular piston cavity 354 in which a piston 356 is disposed and sealably engaged with a wall of the piston cavity. A first port 366 can be used to flow fluid, such as hydraulic fluid or pneumatic gases, to and from a first portion 354*a* of the piston cavity to actuate the piston 356. Another port 368 can be fluidicly coupled to a second portion 354*b* of the piston cavity that is formed on an opposite portion of the piston 356 from the first portion 354*a* of the piston cavity. Lines or hoses, such as line 369 coupled to port 368, can deliver fluid to one or both of the ports. Line 369 can be disposed external to the upper body 350 and can be used to remotely actuate the piston. A retainer ring 358 is disposed adjacent an end of the piston 356 and in one embodiment is biased radially outward from the bearing housing 362. The retainer ring 358 retains the bearing housing as one example of an assembly to the one or more of the surrounding bodies. Other assemblies, whether including one member or a plurality of members, can be retained by the retainer ring 358. Mating surfaces between the retainer ring 358 and the piston 356 are preferably tapered to allow the piston to force the ring radially inward as the piston moves downward. A corresponding groove 360 formed in the bearing housing 362 is adapted to receive the retainer ring 358 when the retainer ring is biased inward toward the bearing housing. At least one seal 364 can be disposed between the bearing housing 362 and an adjacent surface of the upper body 350 to seal drilling fluids from portions of the piston cavity 354.

The embodiment shown in FIG. 12 could also include other packers and related members, such as shown in FIG. 9. Further, other members of the drilling head 114 could be coupled to the upper or lower bodies in lieu of or in addition to the bearing housing 362.

In operation, fluid can flow through the port 366 into the first portion 354*a* of the piston cavity 354 to force the piston 356 toward the retainer ring 358. For example, fluid disposed in the throat 352 can flow through the port 366 into the piston cavity 354 to bias the piston 356 downward during operation. The piston 356 contacts the retainer ring 358 and forces the retainer ring radially inward toward the groove 360 on the bearing housing 362. The retainer ring 358 engages the groove 360 and retains the bearing housing and related components to the upper body 350. To release the bearing housing 362 from the upper body 350, the piston 356 retracts from engagement with the retainer ring 358. For example, fluid flown through line 369, through port 368 and into the second portion 354*b* of the piston cavity 354 can force the piston 356 upward and override the fluid pressure acting on the top of the piston through port 366. The retainer ring 358 expands radially outward and away from the bearing housing 362. A drill string 110 or other member disposed downhole can be used to lift the bearing housing 362 from the upper body to the surface of the well or drilling platform (not shown).

Variations in the orientation of the packer, bearings, retainer ring, rotating spindle assembly, and other system components are possible. For example, the retainer ring can be biased radially inward or outward. The pistons can be annular or a series of cylindrical pistons disposed about the drilling head. Various portions of the drilling head can be coupled to the upper and/or lower bodies besides the particular members described herein. Other variations are possible and contemplated by the present invention. Further, while the embodiments have discussed drilling heads, the invention can be used to advantage on other tools. Additionally, all movements and positions, such as "above", "top", "below", "bottom", "side", "lower" and "upper" described herein are relative to positions of objects such as the packer, bearings, and retainer ring. Further, terms, such as "coupling", "engaging", "surrounding" and variations thereof, are intended to encompass direct and indirect "coupling", "engaging" and "surrounding" and so forth. For example, a retainer ring can be coupled directly to the packer or can be coupled to the packer indirectly through an intermediate member and fall within the scope of the disclosure. Accordingly, it is contemplated by the present invention to orient any or all of the components to achieve the desired movement of components in the drilling head assembly.

While the foregoing is directed to the preferred embodiment of the present invention, other and further embodiments of the invention may be devised without departing from the basic scope thereof, and the scope thereof is determined by the claims that follow.

What is claimed is:

1. A drilling head, comprising:

a) a non-rotating portion;

b) a first rotating portion and a second rotating portion, at least one rotating portion being rotatably engaged with the non-rotating portion; and c) a selectively disengageable retainer disposed adjacent the first rotating portion and adapted to disengage at least one of the rotating portions from the non-rotating portion; and further comprising at least one bearing annularly disposed between the second rotating portion and the non-rotating portion and a bearing actuator aligned with the bearing.

2. The drilling head of claim 1, wherein the disengageable retainer is disposed about the first rotating portion and is retained at least partially with the second rotating portion, the second rotating portion being annularly disposed between the first rotating portion and the non-rotating portion, and wherein the retainer is adapted to allow separation of the first rotating portion from the second rotating portion and the non-rotating portion.

3. The drilling head of claim 1, wherein the first rotating portion comprises a packer.

4. The drilling head of claim 2, further comprising a piston annularly disposed in the second rotating portion and axially aligned with the retainer.

5. The drilling head of claim 1, further comprising a control unit in communication with the drilling head.

6. The drilling head of claim 5, further comprising a power unit operably connected to the control unit and the drilling head.

7. The drilling head of claim 1, further comprising a control unit connected to the actuator, the control unit being adapted to remotely actuate the actuator.

8. The drilling head of claim 1, further comprising:

a) at least one bearing disposed between the non-rotating portion and the second rotating portion and having at least one moveable bearing race adjacent a remaining portion of the bearing; and b) a bearing actuator disposed adjacent the moveable bearing race and adapted to adjust a position of the moveable bearing race relative to the remaining portion of the bearing.

9. The drilling head of claim 8, wherein the actuator comprises an annular bearing piston axially aligned with the moveable bearing race.

10. The drilling head of claim 1, further comprising a drive member connected to the first rotating portion, the drive member having at least two symmetrical portions.

11. The drilling head of claim 10, further comprising axially aligned bolt holes in the drive member extending through each symmetrical portion and aligned with a mating portion on an adjacent symmetrical portion.

12. A drilling head, comprising:

a) a non-rotating portion of the drilling head;

b) a rotating portion disposed in proximity to the non-rotating portion;

c) at least one bearing disposed between the non-rotating portion and the rotating portion and having at least one moveable bearing race disposed adjacent a remaining portion of the bearing, wherein movement of the bearing race can be remotely actuated.

13. The drilling head of claim 12, further comprising an actuator disposed adjacent the bearing race and adapted to adjust a position of the moveable bearing race relative to the remaining portion of the bearing.

14. The drilling head of claim 12, wherein the actuator comprises an annular bearing piston axially aligned with the moveable bearing race.

15. The drilling head of claim 12, further comprising a retainer disposed adjacent the rotating portion and adapted to retain the rotating portion in the drilling head.

16. The drilling head of claim 15, wherein the retainer is releasably disposed between a first rotating portion and a second rotating portion.

17. The drilling head of claim 12, further comprising a body at least partially surrounding at least the rotating portion, the body having an opening formed therein sufficiently sized to allow at least the rotating portion to be lifted through the body.

18. A drilling head, comprising:

a) a non-rotating portion;

b) a first rotating portion and a second rotating portion, at least one rotating portion being rotatably engaged with the non-rotating portion; and c) a selectively disengageable retainer disposed adjacent the first rotating portion and adapted to disengage at least one of the rotating portions from the non-rotating portion; and further comprising at least one bearing disposed between the non-rotating portion and the second rotating portion and having at least one moveable bearing race adjacent a remaining portion of the bearing; and a bearing actuator disposed adjacent the moveable bearing race and adapted to adjust a position of the moveable bearing race relative to the remaining portion of the bearing.

19. The drilling head of claim 18, wherein the disengageable retainer is disposed about the first rotating portion and is retained at least partially with the second rotating portion, the second rotating portion being annularly disposed between the first rotating portion and the non-rotating portion, and wherein the retainer is adapted to allow separation of the first rotating portion from the second rotation portion and the non-rotating portion.

20. The drilling head of claim 18, wherein the first rotating portion comprises a packer.

21. The drilling head of claim 19, further comprising a piston annularly disposed in the second rotating portion and axially aligned with the retainer.

22. The drilling head of claim 18, further comprising a control unit in communication with the drilling head.

23. The drilling head of claim 22, further comprising a power unit operably connected to the control unit and the drilling head.

24. The drilling head of claim 18, further comprising at least one bearing annularly disposed between the second rotating portion and the non-rotating portion and a bearing actuator aligned with the bearing.

25. The drilling head of claim 24, further comprising a control unit connected to the actuator, the control unit being adapted to remotely actuate the actuator.

26. A drilling head, comprising:

a) a non-rotating portion;

b) a first rotating portion and a second rotating portion, at least one rotating portion being rotable engaged with the non-rotating portion; and a selectively disengageable retainer disposed adjacent the first rotating portion and adapted to disengage at least one of the rotating portions from the non-rotating portion; and further comprising at least one bearing disposed between the non-rotating portion and the second rotating portion and having at least one moveable bearing race adjacent a remaining portion of the bearing; and a bearing actuator disposed adjacent the moveable bearing race and adapted to adjust a position of the moveable bearing race relative to the remaining portion of the bearing; and wherein the actuator comprises an annular bearing piston axially aligned with the moveable bearing race.

27. A drilling head, comprising:

a) a non-rotating portion;

b) a first rotating portion and a second rotating portion, at least one rotating portion being rotatably engaged with the non-rotating portion; and c) a selectively disengageable retainer disposed adjacent the first rotating portion and adapted to disengage at least one of the rotating portions from the non-rotating portion; and further comprising a drive member connected to the first rotating portion, the drive member having at least two symmetrical portions; and further comprising axially aligned bolt holes in the drive member extending through each symmetrical portion and aligned with a mating portion on an adjacent symmetrical portion.

28. The drilling head of claim 27, further comprising axially aligned bolt holes in the drive member extending through each symmetrical portion and aligned with a mating portion on an adjacent symmetrical portion.

* * * * *